US007802497B1

(12) United States Patent
Hartzog et al.

(10) Patent No.: US 7,802,497 B1
(45) Date of Patent: Sep. 28, 2010

(54) IMPACT ABSORBING STRIKING TOOL

(75) Inventors: Terry Hartzog, Lima, OH (US); Jim Kreitzer, Wapakoneta, OH (US)

(73) Assignee: Honda Motor Co., Ltd., Tokyo (JP)

( * ) Notice: Subject to any disclaimer, the term of this patent is extended or adjusted under 35 U.S.C. 154(b) by 80 days.

(21) Appl. No.: 12/189,554

(22) Filed: Aug. 11, 2008

(51) Int. Cl.
*B25D 1/12* (2006.01)

(52) U.S. Cl. ..... 81/22

(58) Field of Classification Search ..... 81/19, 81/22, 27; 72/465.1, 466.5, 466.6, 466.8
See application file for complete search history.

(56) References Cited

U.S. PATENT DOCUMENTS

| | | | | |
|---|---|---|---|---|
| 2,321,225 | A * | 6/1943 | McIntire | 72/466.5 |
| 4,498,464 | A * | 2/1985 | Morgan, Jr. | 601/107 |
| 5,262,113 | A | 11/1993 | Carmien | |
| 5,375,487 | A | 12/1994 | Zimmerman | |
| 5,657,674 | A | 8/1997 | Burnett | |
| 6,023,997 | A | 2/2000 | Willis et al. | |
| 6,052,885 | A | 4/2000 | Carmien | |
| 6,128,977 | A | 10/2000 | Gierer et al. | |
| 6,467,376 | B1 | 10/2002 | Wu | |
| 6,595,087 | B2 | 7/2003 | Whalen et al. | |
| 6,739,218 | B2 | 5/2004 | Yang | |
| 6,983,674 | B1 * | 1/2006 | Rufolo, Jr. | 81/22 |
| 7,168,338 | B2 | 1/2007 | Hopper, Jr. et al. | |
| 7,191,685 | B2 * | 3/2007 | Lowther | 81/27 |
| 2005/0097708 | A1 * | 5/2005 | Crawford | 16/431 |
| 2005/0252345 | A1 | 11/2005 | Carmien et al. | |

* cited by examiner

*Primary Examiner*—David B Thomas
(74) *Attorney, Agent, or Firm*—Standley Law Group LLP

(57) ABSTRACT

A straight line impact absorbing striking tool for impacting an object. The striking tool may have a multi-piece construction, and may be partially filled with a flowable high-density material and/or may include a spring-loaded handle to help absorb impact recoil energy that would otherwise be undesirably transferred to the hand(s) and arm(s) of a user. At least a striking section or striking surface of such a tool may be comprised of a material that will not mar or otherwise damage an impacted target object.

20 Claims, 6 Drawing Sheets

IMPACT ABSORBING STRIKING TOOL

BACKGROUND

The present invention is directed to a striking tool that can be used to impact an object without causing damage thereto. More particularly, the present invention is directed to a straight line striking tool that also absorbs impact forces during use.

Striking tools for impacting objects or work surfaces are well known in the art. For example, various hammers have been created specifically for this purpose. Such hammers typically have a head for performing the actual striking function and a handle extending at or near a right angle therefrom for gripping by as user.

In some situations, a hammer of common design cannot be employed due to space constraints that prohibit effective swinging. As such, inline or straight line hammers have been developed that permit use in a more compact space. Unlike a typical hammer, which is swung by its extending handle, a straight line hammer is designed to impact a target while being propelled along a path substantially parallel to its longitudinal axis.

It is sometimes also necessary that no damage or deformation of the target to be impacted results from contact with a hammer or other striking tool. To this end, such tools have been designed with head portions comprised of malleable materials such as aluminum, brass and other such metals. Straight line hammers having such malleable head portions are commonly used, for example, during the assembly of various die components to stamping and molding dies.

As can be easily appreciated by one of skill in the art, the forceful contact of a hammer or other striking tool with a target typically generates recoil and other impact forces that are undesirably transferred to a user thereof. This side effect may be exacerbated in the case of a straight line hammer due to the alignment of recoil forces with the hands and arms of a user.

To combat this undesirable transfer of impact forces, a number of different recoil absorbing striking tools having a typical swingable hammer construction have been designed. Such devices are commonly referred to as, for example, dead blow hammers. However, applicants are unaware of any such devices that also incorporate a malleable or otherwise non-destructive striking portion. Nor are applicants aware of any such devices that are designed to be used in an inline manner.

Consequently, it can be understood that there is a need for an inline striking device having such impact absorbing and non-damaging characteristics. An impact absorbing striking tool of the present invention satisfies this need.

SUMMARY OF THE OF THE GENERAL INVENTIVE CONCEPT

The present invention is directed to an impact absorbing striking tool that can be used to impact an object while also absorbing much of the resulting impact energy that would otherwise be transferred to a user's hands and or arms. An impact absorbing striking tool of the present invention is designed to be propelled into target object in a substantially straight line.

Certain embodiments of an impact absorbing striking tool of the present invention may be at least partially constructed of a substantially malleable or otherwise soft material, such that the impact absorbing striking tool will not mar or otherwise damage the impacted object. In certain embodiments, the entire impact absorbing striking tool may be comprised of such a material(s). While it is realized that such a construction would result in less impact force absorption, yet other impact absorbing striking tool embodiments of the present invention may be comprised of steel or other hardened materials typically used in the manufacture of hammers and other similar devices.

Preferably, an impact absorbing striking tool of the present invention is of multi-piece construction. For example, an impact absorbing striking tool of the present invention may include a forward, impacting section, which may be partially hollow so as to contain an amount of flowable high-density material, a rearward section that engages the impacting section, and a handle. Such an impact absorbing striking tool of the present invention may also include a cap or similar means for retaining the flowable high-density material within the impacting section. Preferably, the handle of such an impact absorbing striking tool of the present invention is also spring loaded to further absorb impact forces generated during its use.

Variations of the foregoing construction are possible. Nonetheless, an impact absorbing striking tool of the present invention is of sufficient mass to effectively impact a target object, while simultaneously absorbing much of the impact energy that would otherwise be undesirably transferred to the user. While it is possible to impact an object by swinging an impact absorbing striking tool of the present invention like a conventional hammer, impact absorbing striking tools of the present invention are designed to be most effective when propelled toward a target object along a substantially linear path. A better understanding of the present invention can be gained through review of the exemplary embodiment described below and illustrated in the accompanying drawing figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 1:
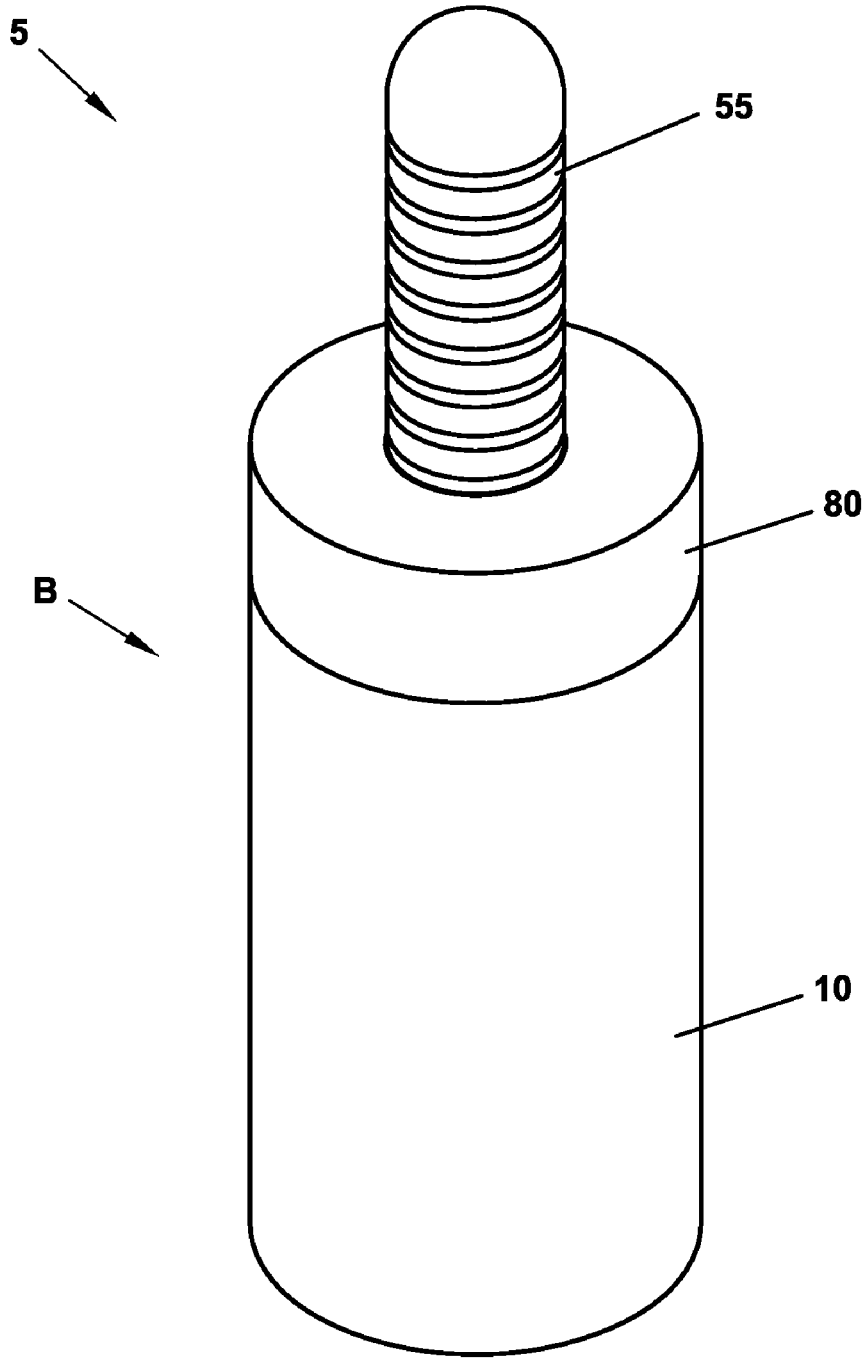
FIG. 1 is an assembled perspective view of one exemplary embodiment of an impact absorbing striking tool of the present invention.
Figure 2A:
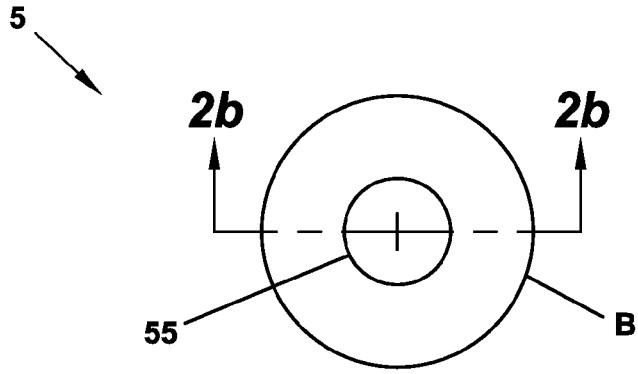
FIGS. 2*a* and 2*b* show a top plan view and an associated cross-section of the impact absorbing striking tool of FIGS. 1-2.
Figure 2B:
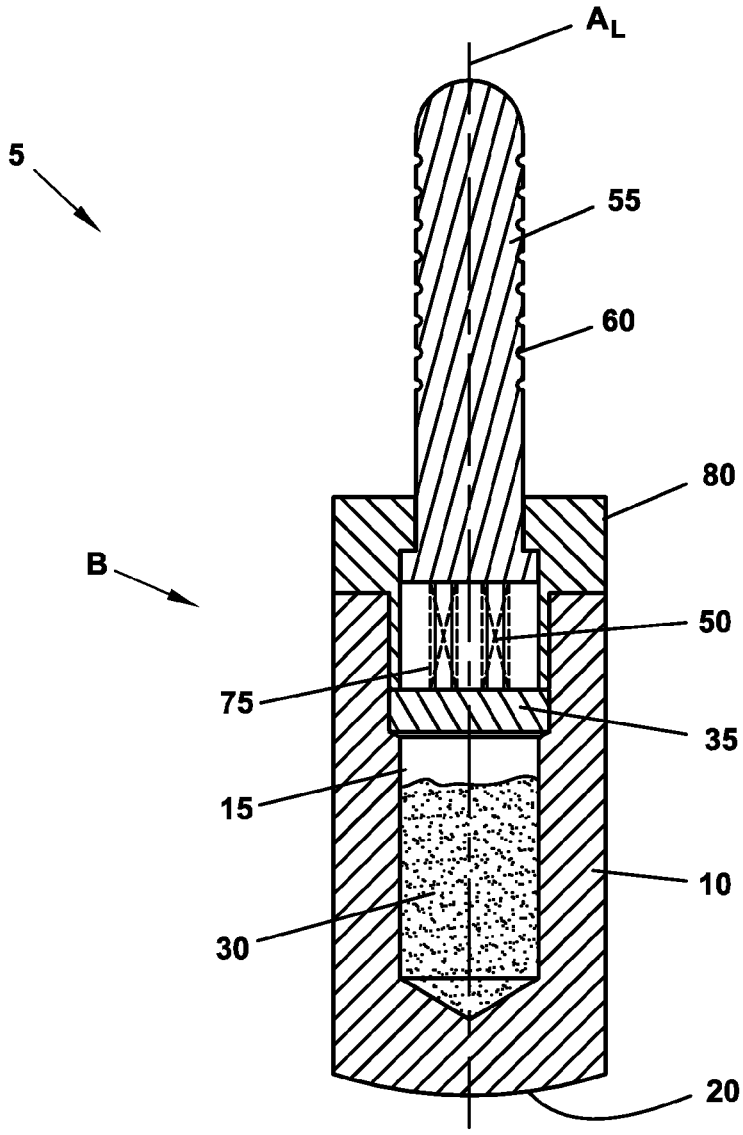
Figure 3A:
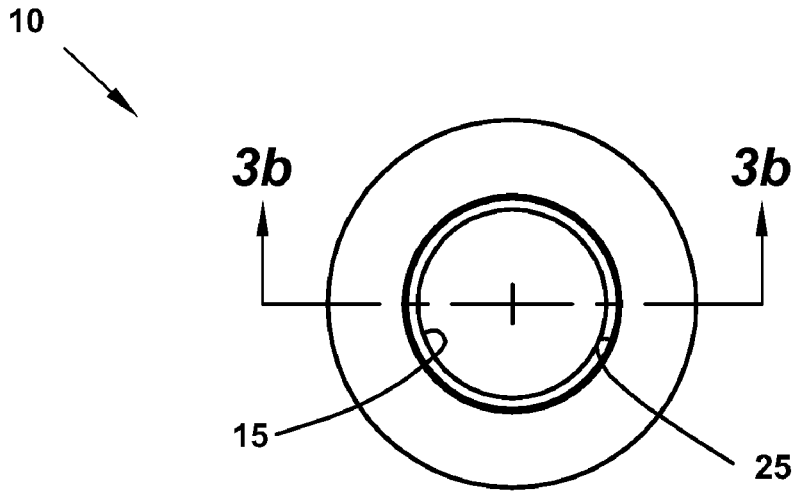
FIGS. 3*a* and 3*b* depict an enlarged top plan view and associated cross-section of an impacting section of the impact absorbing striking tool of FIGS. 1-2.
Figure 3B:
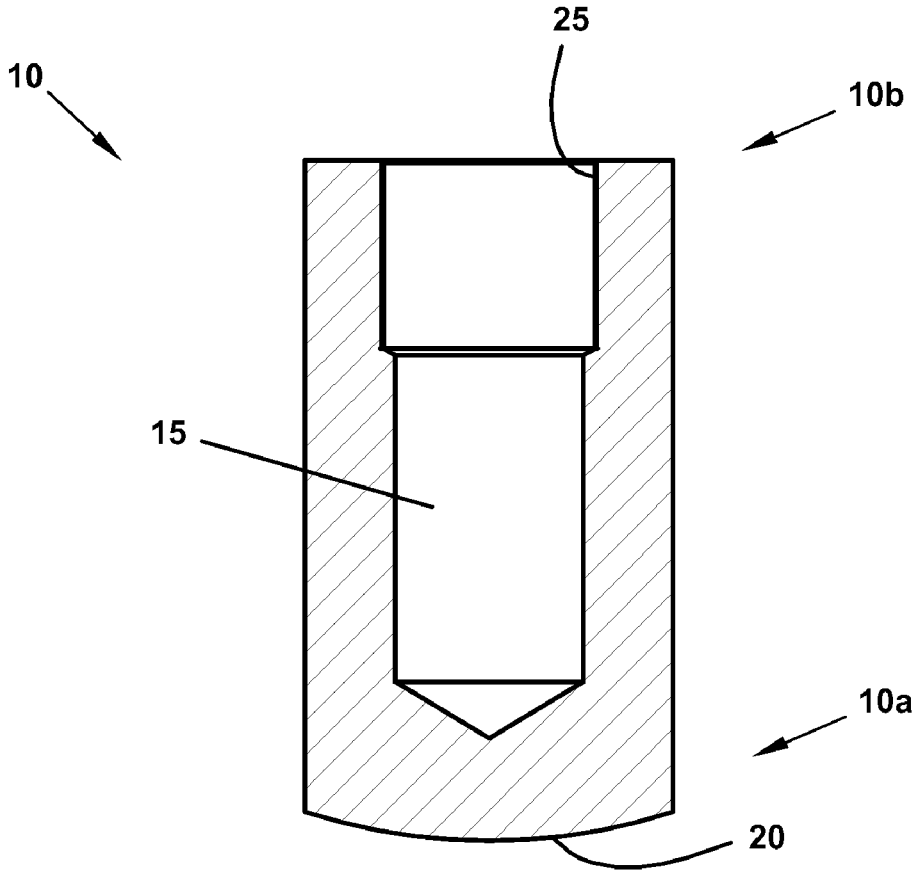
Figure 4B:
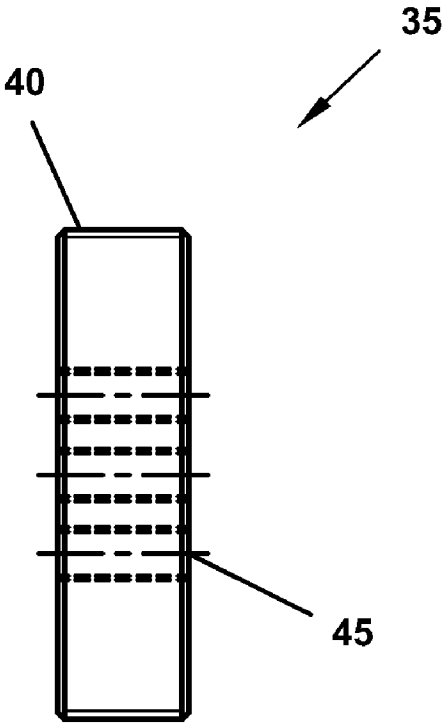
FIGS. 4*a* and 4*b* show an enlarged top plan view and associated side view of a plug of the impact absorbing striking tool of FIGS. 1-2.
Figure 4A:
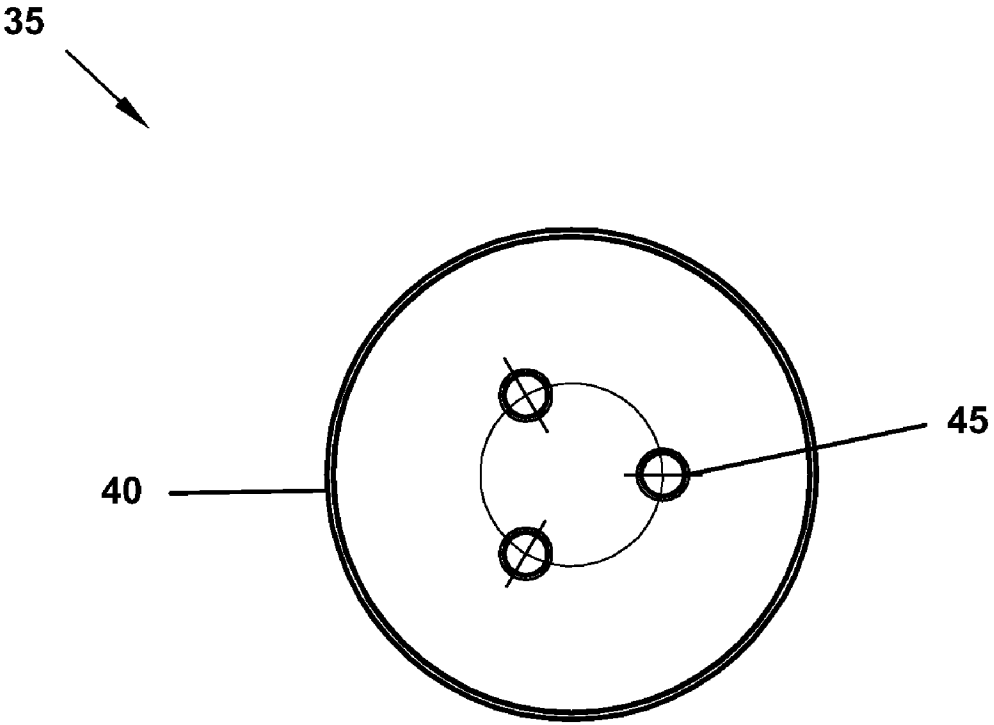

One exemplary embodiment of an assembled impact absorbing striking tool 5 of the present invention can be observed in FIGS. 1-2*b*. As shown, the impact absorbing striking tool 5 includes a body portion B having a forward, impacting section 10, and a rear cap 80. The impacting section 10 of this particular embodiment comprises a substantially cylindrical body having a closed, striking end 10*a*, and an open, rearward end 10*b*. Non-cylindrical shapes are also possible. The impacting section 10 is also shown to include an axial bore that extends from the open end 10*b* toward the closed end 10*a* thereof so as to form a cavity 15 within the impacting section. The cavity 15 terminates at some distance from the exterior striking surface 20 of the impacting section 10. A rearward end of the cavity 15 terminates in a threaded counterbore 25 that extends inward from the open end 10*b* of the impacting section 10.

Preferably, but not necessarily, the cavity 15 is at least partially filled with a flowable high-density material 30. The flowable high-density material 30 adds mass to the impact absorbing striking tool 5 and may act to more effectively transfer the impact energy thereof to a target object. The flowable high-density material 30 also acts to absorb much of the recoil energy that would otherwise be undesirably transferred to the hands and/or arms of a user. The mechanisms associated with the use of a flowable high-density material to transfer impact energy to a target object and to absorb recoil energy are well documented in the art and, therefore, need not be described in detail herein.

The flowable high-density material 30 may comprise small metallic spheres, such as steel or lead shot. As would be understood by one skilled in the art, however, a variety of other materials may also be employed for this purpose. Preferably, the cavity 15 in the impacting section 10 is only partially filled with the flowable high-density material 30, such that the flowable high-density material may shift within the cavity during use of the impact absorbing striking tool 5.

In this particular embodiment, the open end of the cavity 15 is sealed with a plug 35 such that the flowable high-density material 30 is trapped therein. As shown, this particular plug 35 is of circular cross-section and is provided with external threads 40 that engage like-threads of the counterbore 25. The plug 35 is threaded into the counterbore 25 until it seats against the bottom thereof.

Figure 5A:
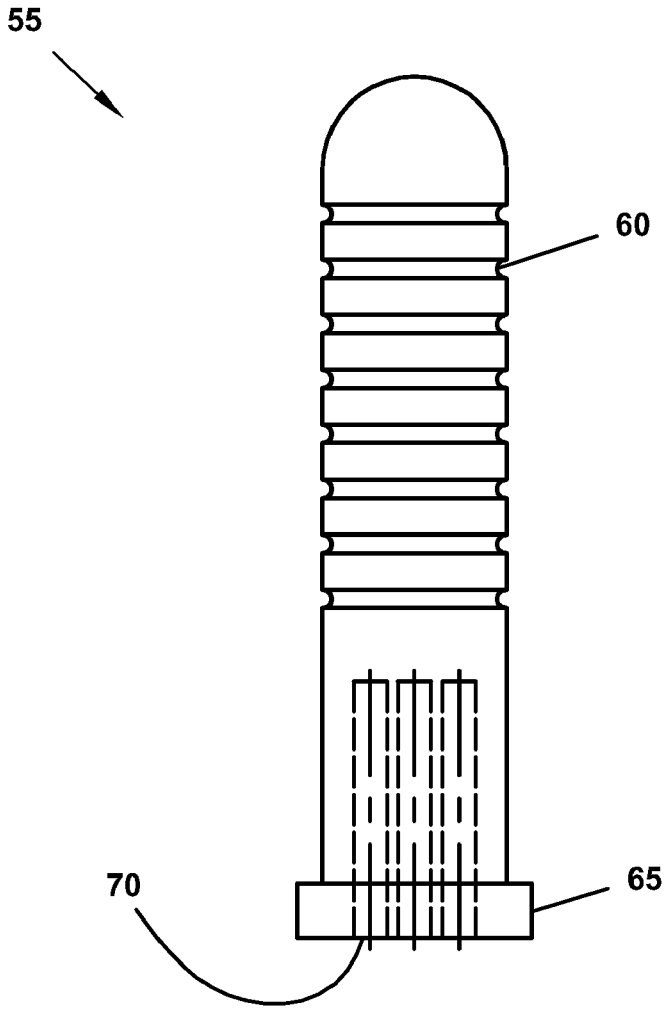
FIGS. 5*a* and 5*b* illustrate an enlarged side view and associated bottom plan view of a handle of the impact absorbing striking tool of FIGS. 1-2.
Figure 5B:
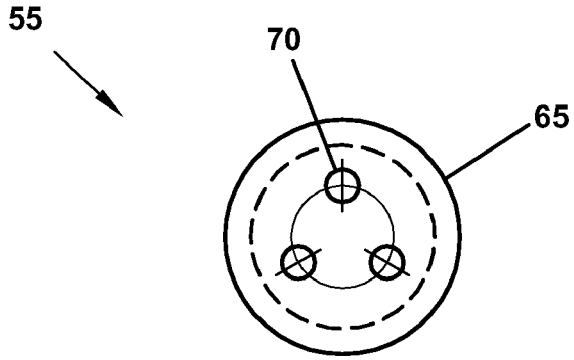

As can be best observed in FIGS. 5*a*-5*b*, the plug 35 may further include a number of threaded holes 45 for receiving a number of corresponding optional threaded guide rods 50. When present, the number and/or arrangement of the threaded holes 45 and corresponding guide rods 50 may vary. As shown, it is preferred that each guide rod 50 be threaded only at the end thereof that is installed into the plug 35. That is, the portion of each guide rod 50 extending from the plug 35 is preferably substantially smooth.

A protruding handle 55 is provided to assist with gripping and using the impact absorbing striking tool 5. The handle 55 extends axially rearward from the body portion B of the impact absorbing striking tool 5 (as described in more detail below). In this particular embodiment, the handle 55 is substantially cylindrical in shape, although other shapes are also possible. As shown, the handle also includes optional grooves 60 along a gripping portion thereof that may help to improve a user's grip during use of the impact absorbing striking tool 5. In lieu of, or in addition to the grooves 60 shown, a handle of an impact absorbing striking tool of the present invention may employ other grip-assisting surface treatments familiar to those skilled in the art. One end of this particular handle 55 terminates in a flange 65 the purpose of which is explained below.

In this exemplary embodiment, the handle 55 is adapted to receive the guide rods 50 that extend from the plug 35. More specifically, and as can be best observed by reference to FIGS. 5*a*-5*b*, the handle 55 is provided with a number of guide bores 70 that extend inward from the flanged end are arranged to be aligned with and sized to receive the guide rods 50 when the handle is assembled to the impact absorbing striking tool 5.

As show, this particular impact absorbing striking tool 5 employs a spring-loaded handle and, therefore, a number of springs 75 reside between the handle flange 65 and the plug 35 of the assembled impact absorbing striking tool 5. As shown in this particular embodiment, a spring 75 surrounds each guide rod 50. However, in other embodiments of the present invention, a spring(s) may surround only certain individual guide rods 50, a spring may be entrapped between the guide rods, or one larger spring may surround all of the guide rods. As explained in more detail below, the springs 75 are retained within a counterbore 100 of a cap component 80 of the impact absorbing striking tool 5.

Once the plug 35 has been installed, the guide rods 50 have been threaded into the plug 35, and the springs have been placed in the counterbore 25, the handle 55 may be installed. Installation of the handle 55 simply entails insertion of the flanged end thereof into the counterbore 25, such that the guide rods 50 are received in the guide bores 70. The guide bores 70 are preferably, but not necessarily, of sufficient depth to allow the spring 75 to fully compress during inward movement of the handle 55.

The handle 55 and springs 75 are retained within the body portion B by the cap 80. The cap 80 has a flange 85 of some thickness that is preferably, but not necessarily, of substantially the same outside diameter (or other exterior shape/dimension) as the impacting section 10. A smaller diameter threaded section 90 extends from the flange 85 to engage the like-threaded counterbore 25 of the impacting section 10 when the impact absorbing striking tool 5 is assembled. The length of the threaded section 90 may vary. As shown, the length of the threaded section 90 may be such that its free end contacts the exposed surface of the plug 35 when the cap 80 is fully assembled to the impacting section 10. In any event, the length of the threaded section 90 should not interfere with the ability of the cap 80 to be securely threaded onto the impacting section 10.

Figure 6A:
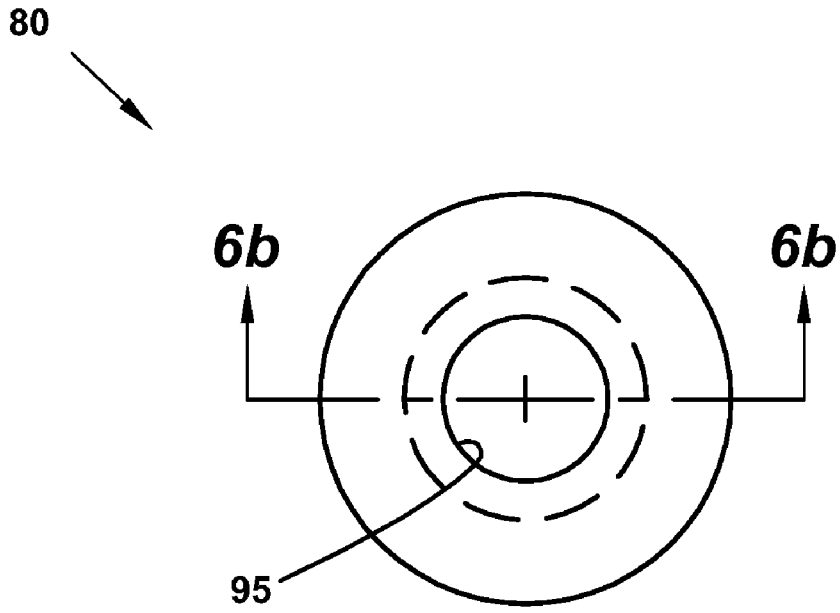
FIGS. 6*a* and 6*b* depict an enlarged top plan view and associated cross-section of a cap of the impact absorbing striking tool of FIGS. 1-2.
Figure 6B:
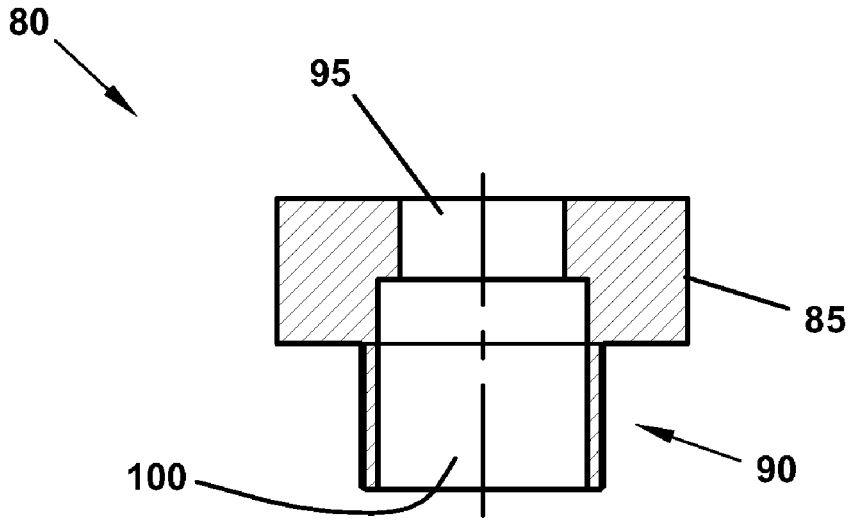

As illustrated most clearly in FIGS. 2*b* and 6*b*, the cap 80 also includes an axial handle receiving aperture 95 that extends inward from the flange 85. The aperture 95 terminates in an axial counterbore 100 that extends inward from the threaded section 90. The aperture 95 allows the handle 55 to extend through the cap 80 and may assist in guiding the movement of the handle. The counterbore 100 is of a diameter sufficient to receive the flanged end 65 of the handle 55. Therefore, in conjunction with the plug 35, the counterbore 100 forms a cavity that permits, guides and limits the reciprocating movement of the handle 55 during use of the impact absorbing striking tool 5. Preferably, the difference between the diameter of the counterbore 100 and the handle flange 65 is large enough to allow for substantially unimpeded movement of the handle flange therein, but small enough to ensure that such movement occurs along the longitudinal axis $A_L$ of the impact absorbing striking tool 5.

During use of the impact absorbing striking tool 5, a user preferably grips the tool by the handle 55 and propels it along a path substantially parallel to its longitudinal axis such that its striking surface 20 impacts a target object. The impact absorbing striking tool 5 may be used with either an underhand or overhand grip, depending on the position of the user and the orientation of the target object. As explained below, the impact absorbing striking tool 5 will absorb undesirable recoil forces in either case.

The static position of the impact absorbing striking tool 5 is best illustrated in FIG. 2*b*. As can be seen, the handle 55 is forced rearward along the guide rods 50 by the springs 75, such that a gap exists between the handle flange 65 and the plug 35. This allows the handle 55 to move inward relative to the body portion B upon sufficient contact (i.e., upon an impact sufficient to compress the springs 75) of the impact absorbing striking tool 5 with a target object. Consequently, when a user drives an impact absorbing striking tool 5 into a target object, both movement of the flowable high-density material 30 within the cavity 15 and compression of the springs 75 by inward movement of the handle 55 act to absorb recoil energy that would otherwise be undesirably transferred to a user's hand and arm. After impact, the position of the handle 55 relative to the body portion B is returned to the static position of FIG. 2*b* by the extension force of the springs 75.

The components of an impact absorbing striking tool of the present invention may be comprised of various materials. For example, the components of the particular impact absorbing striking tool 5 shown in the drawing figures are comprised of medium density nylon so as not to cause damage to die components or other objects to be impacted by the tool. Other materials, such as other plastics and soft or hardened metals may also be used depending on the application to which the impact absorbing striking tool will be applied. It is also possible to manufacture the individual components of a particular impact absorbing striking tool from different materials. For example, the impacting section (or at least the striking surface) of a given impact absorbing striking tool may be comprised of a soft material, while the cap and/or handle may be comprised of a harder material. Many combinations of materials are, of course, possible.

The components of an impact absorbing striking tool of the present invention may also be of various size and shape. Therefore, while an exemplary impact absorbing striking tool having a cylindrical shape has been shown and described herein, other shapes are also possible.

It can be understood from the foregoing description that variations of the present invention are possible. Therefore, while certain embodiments of the present invention are described in detail above, the scope of the invention is not to be considered limited by such disclosure, and modifications are possible without departing from the spirit of the invention as evidenced by the following claims:

What is claimed is:

1. A straight line impact absorbing striking tool comprising:

a body portion having a leading striking surface for impacting a target object;

a plugged cavity within said body portion, said cavity containing an amount of a flowable high-density material;

a handle having a first end retained within a bore in said body portion and a second end extending rearward through an aperture in said body portion and substantially along the longitudinal axis thereof; and at least one spring located between said first end of said handle and a bottom wall of said bore;

wherein, upon propelling said striking tool into a target object along a path substantially parallel to said longitudinal axis thereof, movement of said flowable high-density material within said cavity and compression of said spring by said handle act to absorb impact recoil forces.

2. The striking tool of claim 1, wherein said body portion is comprised of a forward impacting section in threaded engagement with a rear cap.

3. The striking tool of claim 2, wherein said impacting section contains said cavity, and said cap contains said bore that houses said first end of said handle.

4. The striking tool of claim 3, wherein said cap includes an extending threaded section that threads into a like-threaded counterbore in said impacting section.

5. The striking tool of claim 4, wherein an open end of said cavity is sealed by a threaded plug that resides at a bottom of said counterbore.

6. The striking tool of claim 4, wherein said threaded plug forms said bottom wall of said bore that entraps said first end of said handle and said at least one spring.

7. The striking tool of claim 5, further comprising a number of threaded holes in said plug and a number of corresponding guide bores in said first end of said handle, a number of guide rods threaded into said holes in said plug and received in said guide bores in said handle to guide reciprocating movement of said handle within said bore in said cap.

8. The striking tool of claim 1, wherein at least an exposed portion of said handle is imparted with a surface texture that improves its grippability.

9. The striking tool of claim 1, wherein at least said body portion is comprised of a material that is sufficiently soft so as not to mar or otherwise damage said target object.

10. The striking tool of claim 1, wherein at least said body portion is comprised of plastic.

11. A straight line impact absorbing striking tool comprising:

a body portion having an impacting section with a leading striking surface for impacting a target object, and a removable rear cap;

a plugged cavity within said impacting section, said cavity containing an amount of a flowable high-density material;

a handle having a first end retained within a bore in said rear cap and a second end extending rearward through an aperture in said rear cap and along the longitudinal axis of said body portion; and at least one spring located within said bore in said rear cap, between said first end of said handle and said plugged cavity in said impacting section;

wherein, upon propelling said striking tool into a target object along a path substantially parallel to said longitudinal axis thereof, movement of said flowable high-density material within said cavity and compression of said at least one spring by said handle act to absorb impact recoil forces.

12. The striking tool of claim 11, wherein said cap includes an extending threaded section that threads into a like-threaded counterbore in said impacting section.

13. The striking tool of claim 12, wherein an open end of said cavity is sealed by a threaded plug that resides at a bottom of said counterbore.

14. The striking tool of claim 13, wherein said threaded plug forms a bottom wall of said bore that entraps said first end of said handle and said at least one spring.

15. The striking tool of claim 13, further comprising a number of threaded holes in said plug and a number of corresponding guide bores in said first end of said handle, a number of guide rods threaded into said holes in said plug and received in said guide bores in said handle to guide reciprocating movement of said handle within said bore in said cap.

16. The striking tool of claim 11, wherein at least an exposed portion of said handle is imparted with a surface texture that improves its gripability.

17. The striking tool of claim 11, wherein at least said body portion is comprised of a material that is sufficiently soft so as not to mar or otherwise damage said target object.

18. The striking tool of claim 11, wherein at least said body portion is comprised of plastic.

19. A straight line impact absorbing striking tool comprising:

a body portion having a forward impacting section with a leading striking surface for impacting a target object, and a removable rear cap threaded into a like-threaded counterbore at a rear of said impacting section;

a cavity within said impacting section, said cavity containing an amount of a flowable high-density material;

a plug threaded into said counterbore in said impacting section for sealing said cavity, said plug including a number of longitudinally oriented threaded holes;

a number of guide rods threaded at one end thereof into said threaded holes in said plug, said guide rods extending rearward toward said rear cap;

a handle having a flanged end retained within a bore in said rear cap and an opposite end extending rearward through an aperture in said rear cap and along the longitudinal axis of the body portion;

a number of guide bores extending from said flanged end of said handle toward said opposite end, said guide bores of appropriate size and arrangement to receive said guide rods so as to provide for guided reciprocating movement of said handle; and at least one spring located within said bore in said rear cap, between said flanged end of said handle and said threaded plug;

wherein, upon propelling said striking tool into a target object along a path substantially parallel to said longitudinal axis thereof, movement of said flowable high-density material within said cavity and compression of said at least one spring by said handle act to absorb impact recoil forces.

20. The striking tool of claim 19, wherein at least said body portion is comprised of plastic.

* * * * *